US007331202B2

(12) United States Patent
Park et al.

(10) Patent No.: US 7,331,202 B2
(45) Date of Patent: Feb. 19, 2008

(54) DRUM-TYPE WASHING MACHINE WITH ROTATABLE PULSATOR

(75) Inventors: Jae-Ryong Park, Suwon-si (KR); Hyung-Gyoon Kim, Suwon-si (KR); Sang-Yeon Pyo, Suwon-si (KR); Seon-Woo Park, Suwon-si (KR); Hye Soon Yang, Yongin (KR); Seong Min Oak, Masan (KR); Byoung Yull Yang, Ansan (KR); Hyun Sook Kim, Suwon (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 613 days.

(21) Appl. No.: 10/810,647

(22) Filed: Mar. 29, 2004

(65) Prior Publication Data

US 2005/0011235 A1 Jan. 20, 2005

(30) Foreign Application Priority Data

Jul. 19, 2003 (KR) ..... 10-2003-0049583

(51) Int. Cl.
*D06F 29/00* (2006.01)

(52) U.S. Cl. ..... 68/23.6; 68/23.7; 68/131; 68/133; 68/134

(58) Field of Classification Search ..... 68/131, 68/132, 133, 23.6, 23.7, 134, 30
See application file for complete search history.

(56) References Cited

U.S. PATENT DOCUMENTS

| | | | | |
|---|---|---|---|---|
| 5,327,603 | A * | 7/1994 | Roh et al. | 8/159 |
| 5,551,262 | A * | 9/1996 | Seo | 68/23.7 |
| 5,727,404 | A * | 3/1998 | Cho | 68/133 |
| 5,794,633 | A | 8/1998 | Song | |
| 5,850,750 | A | 12/1998 | Cho | |
| 5,865,046 | A * | 2/1999 | Na et al. | 68/23.6 |
| 5,950,460 | A * | 9/1999 | Oh | 68/134 |
| 6,145,350 | A | 11/2000 | Hwang | |

FOREIGN PATENT DOCUMENTS

| | | |
|---|---|---|
| FR | 1 125 004 | 10/1956 |
| GB | 2 315 782 | 2/1998 |
| KR | 1001443290000 | 4/1998 |
| KR | 1001931670000 | 2/1999 |

* cited by examiner

*Primary Examiner*—Michael Barr
*Assistant Examiner*—Jason Heckert
(74) *Attorney, Agent, or Firm*—Staas & Halsey LLP

(57) ABSTRACT

A drum-type washing machine including a rotatable pulsator. The drum-type washing machine includes a water tub to contain water therein. A rotary drum is included in the water tub and rotating in alternating directions to hold laundry located in the rotary drum to be washed. A pulsator is rotatably mounted to a predetermined position of the rotary drum. A rotation guide unit rotates the pulsator by a rotating force of the rotary drum. The pulsator mounted to the rotary drum increases a physical force applied to laundry, thus enhancing a washing effect.

9 Claims, 6 Drawing Sheets

DRUM-TYPE WASHING MACHINE WITH ROTATABLE PULSATOR

CROSS-REFERENCE TO RELATED APPLICATIONS

This application claims the benefit of Korean Application No. 2003-49583, filed on Jul. 19, 2003, in the Korean Intellectual Property Office, the disclosure of which is incorporated herein by reference.

BACKGROUND OF THE INVENTION

1. Field of the Invention

The present invention relates, in general, to a drum-type washing machine, and more particularly, to a drum-type washing machine equipped with a pulsator which is rotatable in a rotary drum, thus having strong washing effect.

2. Description of the Related Art

Generally, a drum-type washing machine includes a cabinet, a door, a cylindrical water tub, a rotary drum, and a motor. The door is hinged to a front of the cabinet. The water tub is opened at a front thereof to have an opening which is opened toward the door. The rotary drum is set in the water tub to be rotatable in alternating directions. The motor functions to rotate the rotary drum. Further, a lifter is mounted on a side of the rotary drum.

The drum-type washing machine is operated as follows. As the rotary drum is rotated by the motor, the lifter mounted on the rotary drum is rotated along with the rotary drum to move laundry located in the bottom of the rotary drum upward, and allow the laundry to be pulled from a top to the bottom inside the rotary drum due to gravity. The laundry is repeatedly moved upward and dropped to the bottom during a washing operation, to apply a physical impact on the laundry.

A washing power is induced by friction between articles of laundry or friction between the laundry and the rotary drum, in addition to the physical impact applied to the laundry. However, the washing power applied to the laundry is weak, thus resulting in a long washing time and high detergent consumption.

To solve the problem, there has been proposed a drum-type washing machine disclosed by Korean Patent No. 0144329, wherein a pulsator is installed at a center of a rotary drum to increase a washing power. However, since conventional drum-type washing machine has the pulsator installed at the center of the rotary drum, sufficient physical force is not applied to the laundry which is located in the bottom of the rotary drum. Further, the conventional drum-type washing machine has another problem in that the pulsator is designed to be rotated in any direction, thus it is impossible to desirably apply a physical force to the laundry.

SUMMARY OF THE INVENTION

Accordingly, it is an aspect of the present invention to provide a drum-type washing machine, which is designed to increase a physical force applied to laundry, thus maximizing a washing power, and reducing a washing time as well as consumption of a detergent.

Additional aspects and/or advantages of the invention will be set forth in part in the description which follows and, in part, will be obvious from the description, or may be learned by practice of the invention.

The foregoing and/or other aspects are achieved by providing a drum-type washing machine, comprising a water tub to contain water therein, a rotary drum included in the water tub and rotating in alternating directions to hold laundry located in the rotary drum to be washed, a pulsator rotatably mounted at a predetermined position on the rotary drum, and a rotation guide unit to rotate the pulsator by a rotating force of the rotary drum.

The rotation guide unit comprising a ring gear mounted at a predetermined position on the water tub, and a pinion engaging with the ring gear. The pulsator comprising a rotating plate rotating in the rotary drum, and a rotating shaft to connect the rotating plate to the pinion of the rotation guide unit.

Further, a washing blade is mounted on the rotating plate and projected toward an interior of the rotary drum.

A seat is formed at a predetermined position in the rotary drum to mount the pulsator in the rotary drum.

The drum-type washing machine further comprising a guide unit to guide the pulsator.

The guide unit comprising a guide part having a plate shape and slidably contacting with the rotating plate of the pulsator, a mounting part to mount the guide part to the seat, a central hole formed at a center of the guide part to allow the rotating shaft to pass through the guide part, and a shaft guide part extending from the central hole to guide the rotating shaft.

The shaft guide part comprises a bushing at a predetermined position thereof. The bushing slidably contacts with the rotating shaft.

The guide unit is integrated with the seat into a single structure.

It is another aspect of the present invention to provide a drum-type washing machine comprising a plurality of pulsators arranged around the center of rotation of the rotary drum at regular angular intervals.

BRIEF DESCRIPTION OF THE DRAWINGS

These and/or other aspects and advantages of the invention will become apparent and more readily appreciated from the following description of the embodiments taken in conjunction with the accompanying drawings in which.

DETAILED DESCRIPTION OF THE PREFERRED EMBODIMENTS

Figure 1:
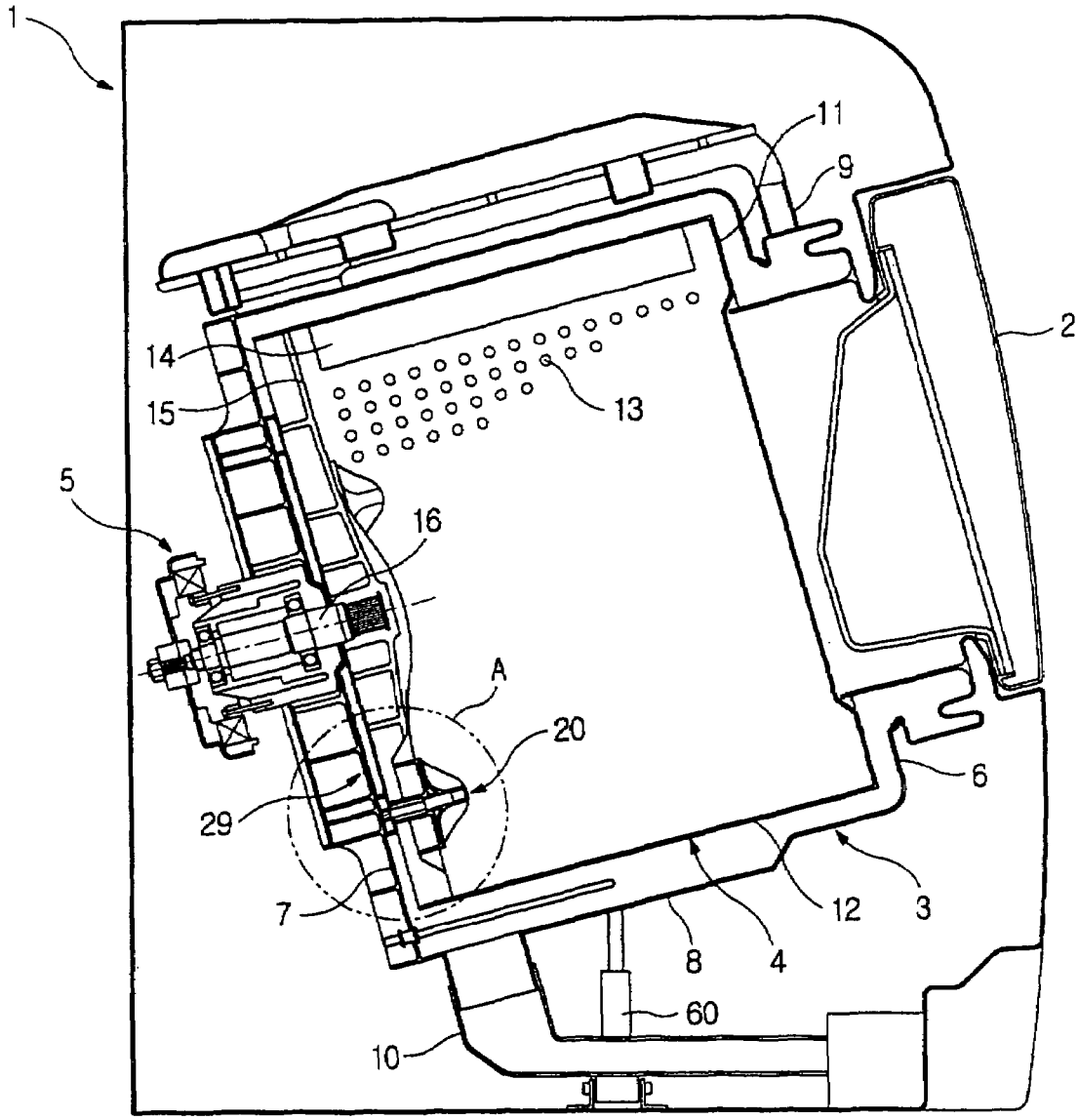
FIG. 1 is a side sectional view illustrating a drum-type washing machine, according to a first embodiment of the present invention.

Reference will now be made in detail to the embodiments of the present invention, examples of which are illustrated in the accompanying drawings, wherein like reference numerals refer to like elements throughout. The embodiments are described below to explain the present invention by referring to the figures.

A drum-type washing machine according to a first embodiment of the present invention, as illustrated in FIG. 1, comprising a cabinet 1, a door 2, a cylindrical water tub 3, a rotary drum 4, and a motor 5. The door 2 is hinged to a front of the cabinet 1. The water tub 3 is opened at a front thereof towards the door 2. The rotary drum 4 is included in the water tub 3 and rotating in alternating directions. The motor 5 rotates the rotary drum 4.

The water tub 3 contains water therein, and is downwardly inclined in a direction from a front wall 6 to a rear wall 7 of the water tub 3. A water supply pipe 9 is connected to an upper portion of a sidewall 8 of the water tub 3 to supply water to the water tub 3. Further, a water drain pipe 10 is connected to a lower portion of the sidewall of the water tub 3 to discharge the water to an outside of the drum-type washing machine.

The rotary drum 4 is opened at a front wall 11 thereof to form an opening. The rotary drum 4 is perforated at a sidewall 12 thereof to form a plurality of perforations 13 through which the water passes. Further, a lifter 14 is laterally mounted to a predetermined position of the sidewall 12 of the rotary drum 4. A pulsator 20 is rotatably mounted to a rear wall 15 of the rotary drum 4 to increase a washing power. A drive shaft 16 extends from the rear wall 15 of the rotary drum 4 to pass through the water tub 3, with the drive shaft 16 being connected to the motor 5.

The rotary drum 4 is concentrically set in the cylindrical water tub 3 to have a common central axis. The drive shaft 16 is placed on the central axis.

Further, a rotation guide unit 29 is installed between the rear wall 15 of the rotary drum 4 and the rear wall 7 of the water tub 3, and rotates the pulsator 20 by a force generated when the rotary drum 4 is rotated. In addition, a support unit 60 is installed in the drum-type washing machine to support the water tub 3.

Figure 2:
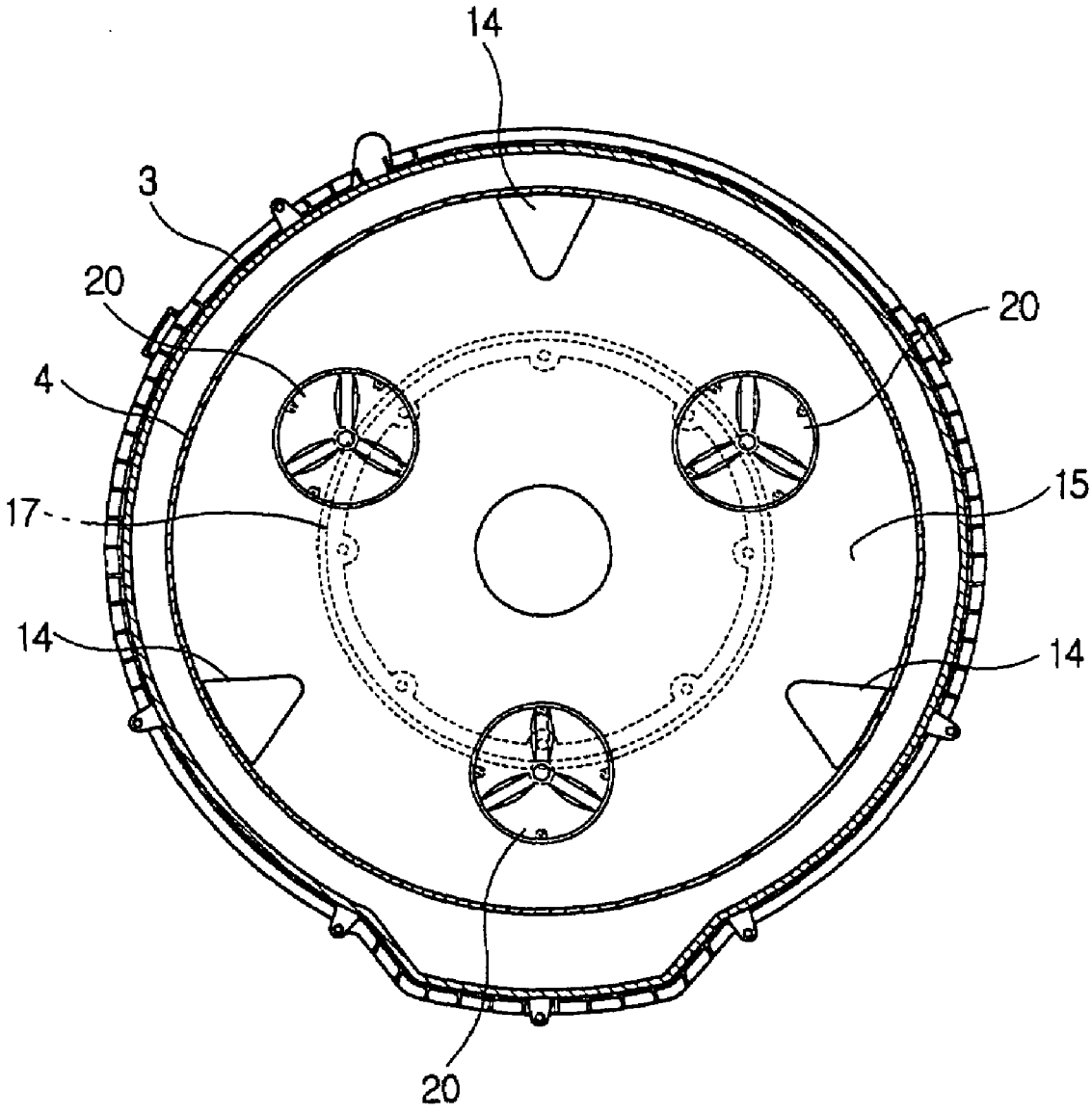
FIG. 2 is a sectional view illustrating an interior of a water tub in the drum-type washing machine of FIG. 1.

In FIG. 2, according to the first embodiment of the present invention, a plurality of pulsators 20 are arranged around the center of the rear wall 15 of the rotary drum 4 at regular angular intervals.

The construction of the pulsator of the drum-type washing machine according to the first embodiment of the present invention will be described in the following in detail, with reference to FIGS. 3 and 4.

Figure 3:
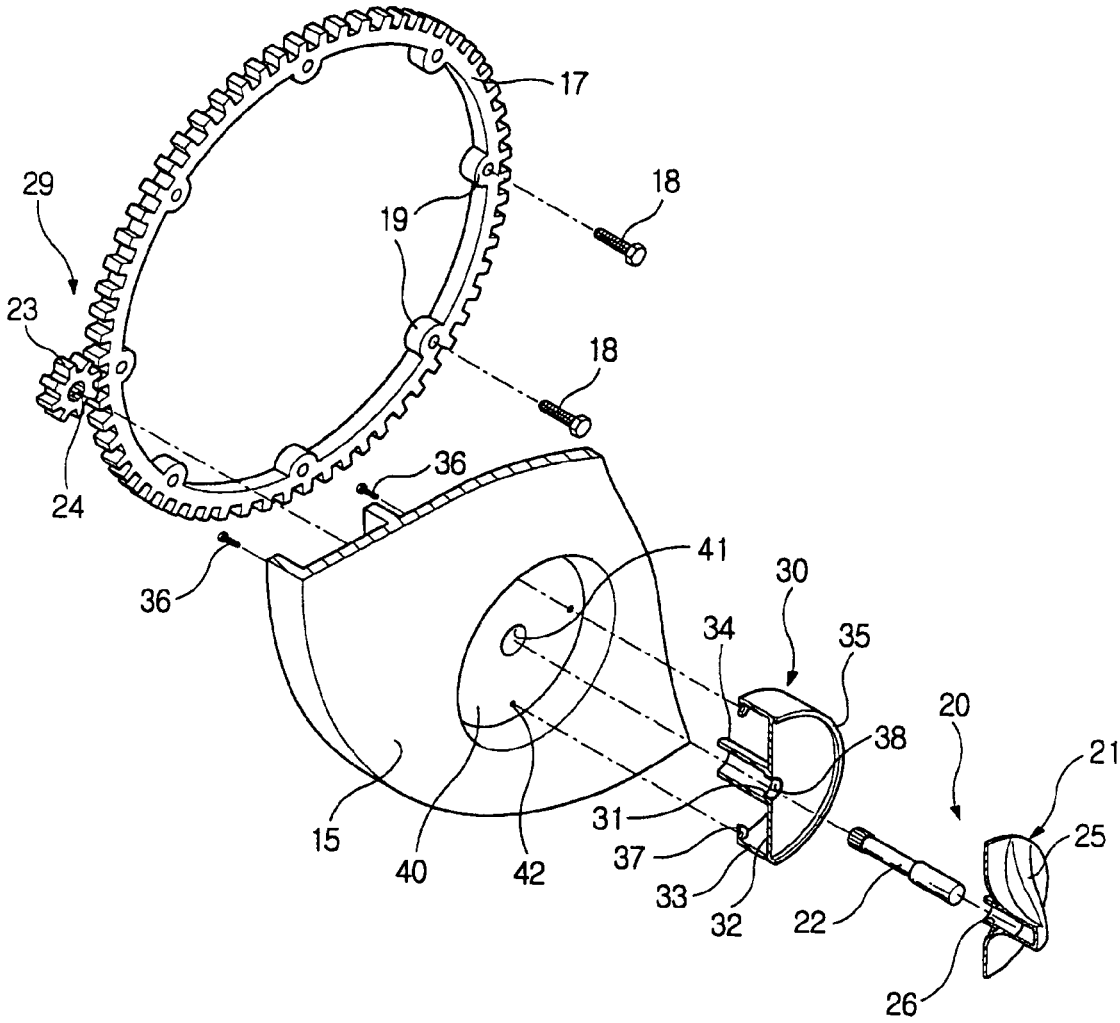
FIG. 3 is an exploded perspective view illustrating a pulsator mounted on a rotary drum of the drum-type washing machine of FIG. 1.
Figure 4:
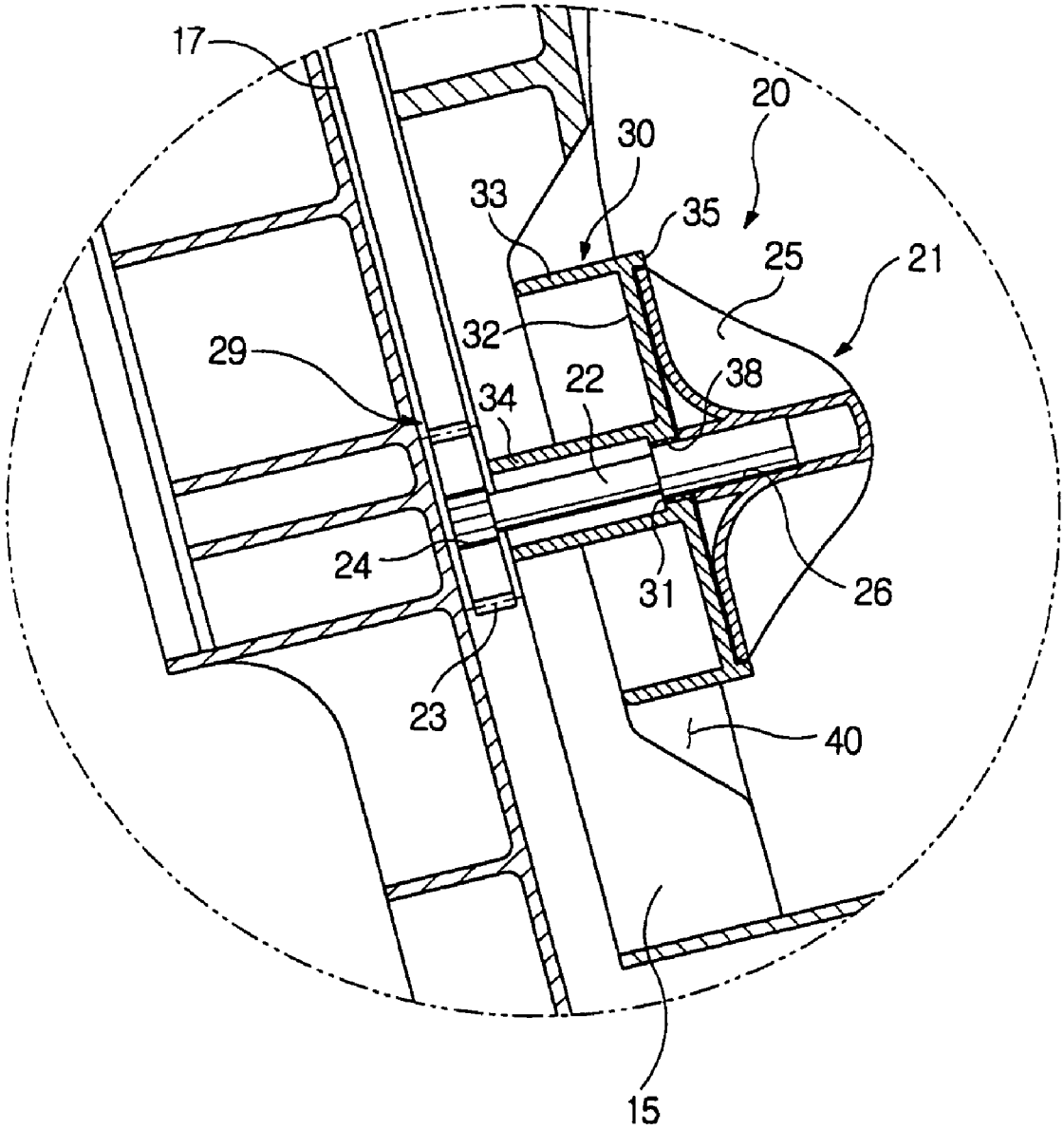
FIG. 4 is an enlarged view of a part A encircled in FIG. 1.

In FIGS. 3 and 4, according to the first embodiment of the present invention, the pulsator 20 comprising a rotating plate 21, and a rotating shaft 22. The rotating plate 21 is formed to be forwardly convex at a central portion thereof. A front end of the rotating shaft 22 is mounted to the central portion of the rotating plate 21. Further, a guide unit 30 is placed between the rotating plate 21 and the rear wall 15 of the rotary drum 4 to guide the rotating plate 21. The rear wall 15 of the rotary drum 4 is depressed to form a seat 40 in which the guide unit 30 is located.

The rotation guide unit 29 to rotate the pulsator 20 comprising a ring gear 17, and a pinion 23. The ring gear 17 is mounted to the rear wall 7 of the water tub 3. The pinion 23 engages with the ring gear 17, and moves along an outer circumferential surface of the ring gear 17.

Washing blades 25 are radially arranged on a front surface of the rotating plate 21. A central channel 26 is formed through a center of the rotating plate 21 to allow the rotating shaft 22 to be inserted into the rotating plate 21.

The guide unit 30 comprising a plate-shaped guide part 32, a cylindrical mounting part 33, and a cylindrical shaft guide part 34. The guide part 32 slidably contacts with the rear surface of the rotating plate 21, and has a central hole 31 through which the rotating shaft 22 passes. The mounting part 33 extends around an edge of the guide part 32, and is positioned in the seat 40. The shaft guide part 34 rearwardly extends from the central hole 31, with the rotating shaft 22 passing through the shaft guide part 34. The mounting part 33 is mounted to the guide part 32 to be slightly and forwardly projected from the guide part 32 at a front end of the mounting part 33, thus forming a guide step 35 to guide a sidewall of the rotating plate 21. The mounting part 33 has first bosses 37 on inside portions of a rear end of the mounting part 33. First setscrews 36 are tightened to the first bosses 37 to fasten the guide unit 30 to the seat 40 formed at the rear wall 15 of the rotary drum 4. Further, the shaft guide part 34 has a bushing 38 in a front portion of the shaft guide part 34, with the bushing 38 slidably contacting with the rotating shaft 22.

A front portion of the rotating shaft 22 passes through the central hole 31 of the guide unit 30, and is inserted into the central channel 26 of the rotating plate 21. A middle portion of the rotating shaft 22 slidably contacts with the bushing 38 of the guide unit 30. Further, a rear portion of the rotating shaft 22 is inserted into an insertion hole 24 which is formed at a center of the pinion 23.

The pinion 23 of the rotation guide unit 29 rotates along the outer circumferential surface of the ring gear 17. The ring gear 17 has second bosses 19 at an inner circumferential surface of the ring gear 17. Second setscrews 18 are tightened to the second bosses 19 to lock the ring gear 17 to the water tub 3.

The rear wall 15 of the rotary drum 4 is concavely depressed to form the circular seat 40, with the guide unit 30 being seated in the seat 40. A through hole 41 is formed at a center of the seat 40 to allow the rotating shaft 22 of the pulsator 20 to pass through the seat 40. Screw holes 42 are formed on the seat 40, thus allowing the first setscrews 36 to pass through the seat 40 prior to being tightened to the first bosses 37 of the guide unit 30.

The operation of the drum-type washing machine according to the first embodiment of the present invention will be described in the following.

Referring to FIG. 1, when a washing operation begins, the motor 5 generates a force to rotate the rotary drum 4. The force is transmitted to the drive shaft 16, thus rotating the rotary drum 4. Then, laundry placed on a bottom of the rotary drum 4 is upwardly moved by the lifter 14 which is mounted to the sidewall 12 of the rotary drum 4, and then is pulled to a bottom of the rotary drum 4 due to gravity. While the laundry is moved upwardly and dropped to the bottom of the rotary drum 4, an impact force and friction between articles of laundry or between the laundry and the rotary drum 4 are generated, thus washing the laundry.

When the rotary drum 4 is rotated, the pinion 23 engages with the ring gear 17 and rotates along with the rotary drum 4. Thus, the pinion 23 revolves on its own axis along the perimeter of the ring gear 17 which is stationary on the rear wall 15 of the rotary drum 4. The revolution and rotation of the pinion 23 is transmitted to the rotating plate 21 through the rotating shaft 22, thus making the rotating plate 21 revolve and rotate in the rotary drum 4.

The operational effect of the rotating plate 21, which revolves and rotates on the rear wall 15 of the rotary drum 4, is as follows. The rear wall 15 of the rotary drum 4 is rearwardly inclined, thus the laundry moves rearwards during the washing operation. The laundry contacts with the rotating plate 21 which is mounted to the rear wall 15 of the rotary drum 4. In this case, the rotating plate 21 revolves around the ring gear 17, thus moving the laundry contacting with the rotating plate 21 upward. In addition, the rotating plate 21 rotates on the own axis thereof, thus twisting the laundry contacting with the rotating plate 21.

Thus, according to the present invention, the pulsator 20 aids an operation of the lifter 14 which moves the laundry upward, in addition to twisting the laundry contacting with the rotating plate 21, thus enhancing the washing effect.

A drum-type washing machine according to a second embodiment of the present invention will be described in the following with reference to the drawings.

Figure 5:
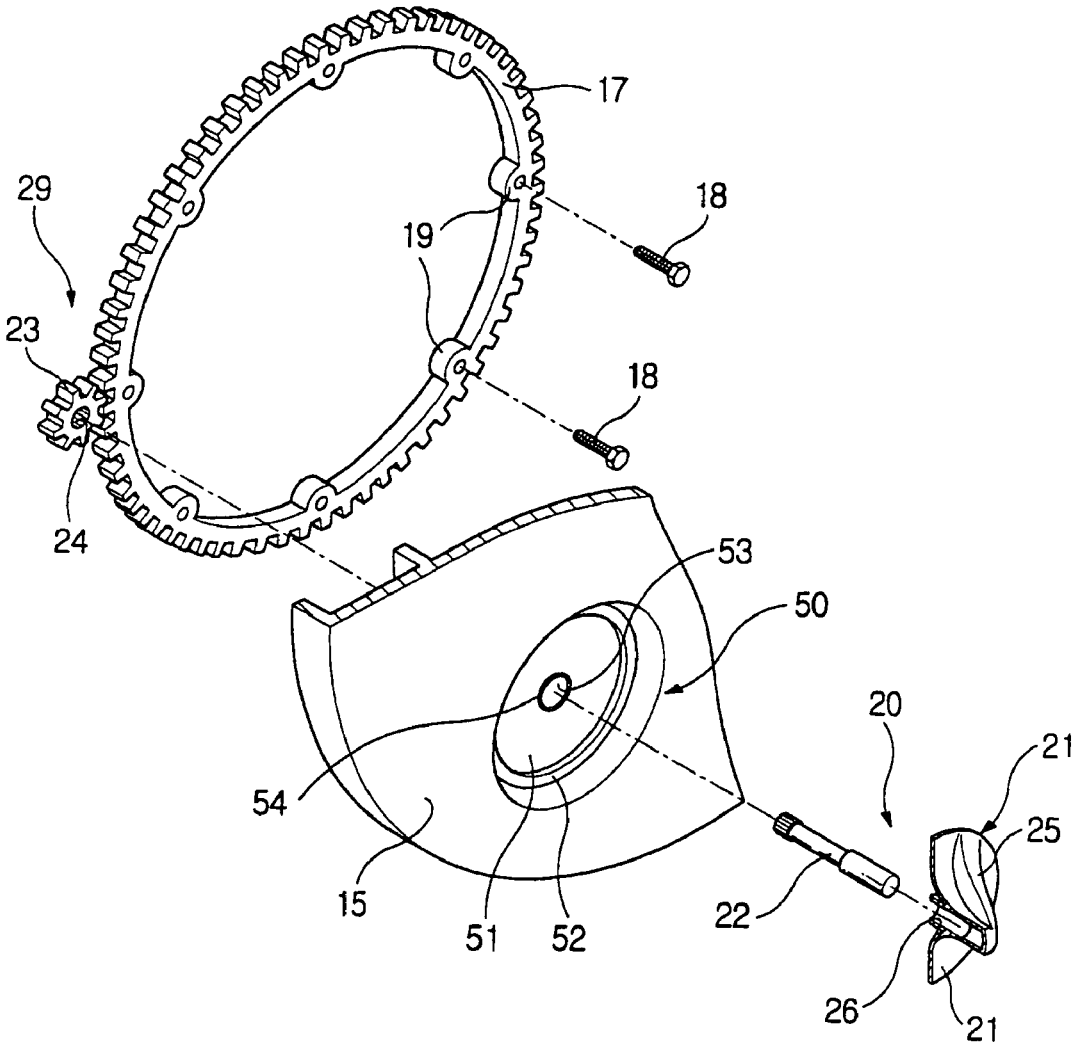
FIG. 5 is an exploded perspective view illustrating a construction of the mounting of a pulsator on a rotary drum of a drum-type washing machine, according to a second embodiment of the present invention.
Figure 6:
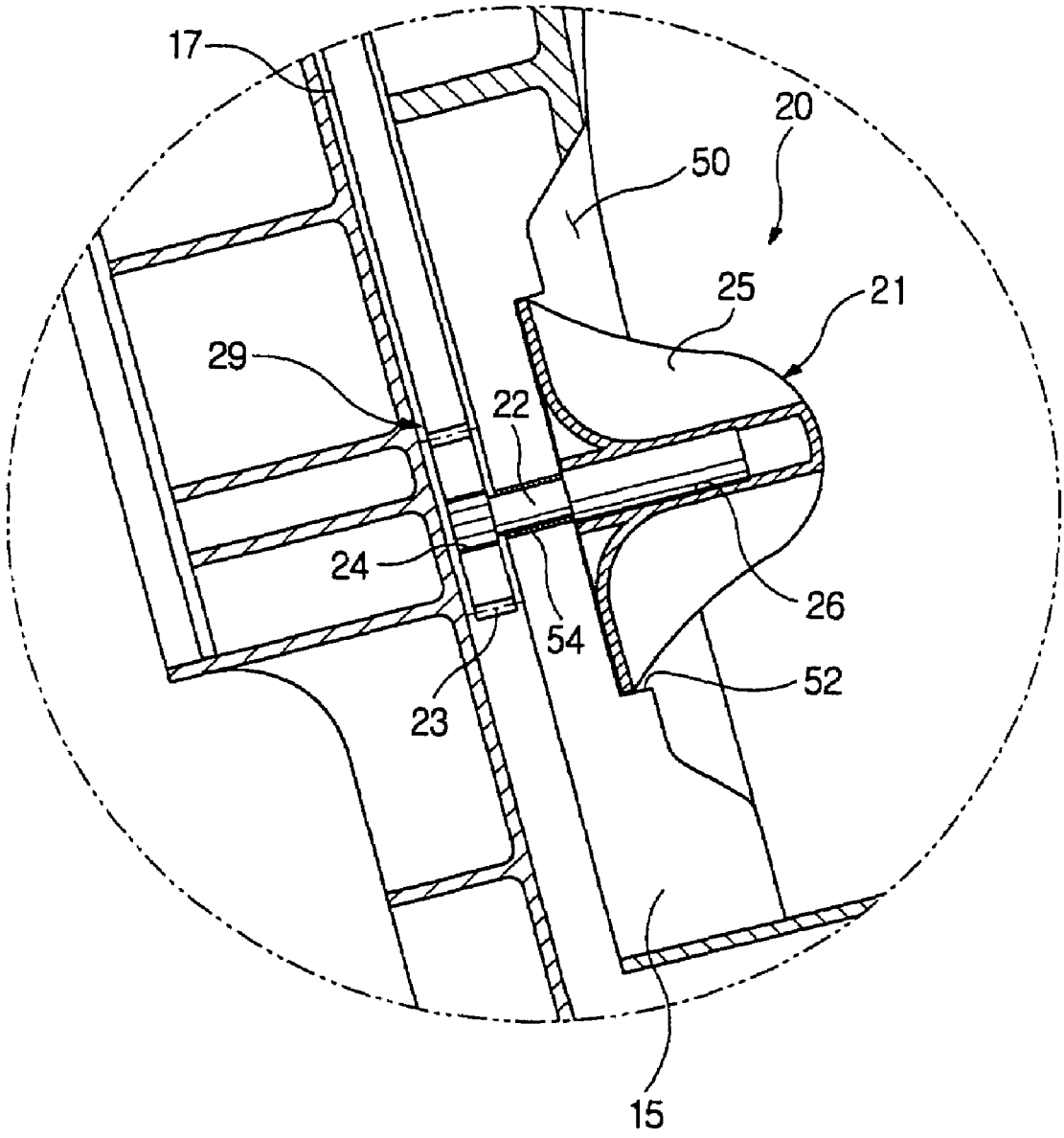
FIG. 6 is a sectional view illustrating a rear wall of the rotary drum to which the pulsator of the drum-type washing machine of FIG. 5 is mounted.

In FIGS. 5 and 6, according to the second embodiment of the present invention, a pulsator 20 includes a rotating plate 21, and a rotating shaft 22. The rotating plate 21 is formed to be forwardly convex at a central portion thereof. A front end of the rotating shaft 22 is mounted to the central portion of the rotating plate 21, while a rear end of the rotating shaft 22 is mounted to a pinion 23 of a rotation guide unit 29.

The rotating plate 21 and the rotating shaft 22 of the second embodiment are the same as the rotating plate and the rotating shaft of the pulsator of the first embodiment, in terms of construction. However, a guide unit 50 included in the drum-type washing machine according to the second embodiment is integrated with a rear wall 15 of a rotary drum 4, differently from the guide unit 30 of the first embodiment.

Thus, only the guide unit 50 of the second embodiment will be described in the following.

According to the second embodiment of the present invention, the guide unit 50 comprising a circular guide surface 51, a guide step 52, a central hole 53, and a bushing 54. The circular guide surface 51 slidably contacts with the rotating plate 21. The guide step 52 is forwardly projected from an edge of the guide surface 51 to guide a sidewall of the rotating plate 21. The central hole 53 is formed at a center of the guide surface 51 to allow the rotating shaft 22 to pass through the guide surface 51. The bushing 54 is placed at an inner circumferential surface of the central hole 53, and slidably contacts with the rotating shaft 22.

The operation of the drum-type washing machine according to the second embodiment is the same as to that of the drum-type washing machine according to the first embodiment.

As apparent from the above description, the present invention provides a drum-type washing machine, which has a rotatable pulsator at a rear wall of a rotary drum, thus aiding an operation of a lifter and twisting laundry, thereby enhancing the washing effect by reducing the washing time and detergent consumption.

Although a few embodiments of the present invention have been shown and described, it would be appreciated by those skilled in the art that changes may be made in these embodiments without departing from the principles and spirit of the invention, the scope of which is defined in the claims and their equivalents.

What is claimed is:

1. A drum-type washing machine, comprising:

a water tub to contain water therein;

a rotary drum included in the water tub and rotating in alternating directions to hold laundry located in the rotary drum to be washed;

a pulsator rotatably mounted at a predetermined position on the rotary drum;

a guide unit to guide the pulsator;

a rotation guide unit to rotate the pulsator by a rotating force of the rotary drum; and a seat formed at a predetermined position in the rotary drum to mount the pulsator in the rotary drum, wherein the rotation guide unit comprises a ring gear mounted at a predetermined position on the water tub, and a pinion engaging with the ring gear, the pulsator comprises a rotating plate rotating in the rotary drum and a rotating shaft to connect the rotating plate to the pinion of the rotation guide unit, and the guide unit comprises a guide part having a plate shape, and slidably contacting with a rear surface of the rotating plate of the pulsator, a mounting part to mount the guide part to the seat and extending around an edge of the guide part, a central hole formed at a center of the guide part to allow the rotating shaft to pass through the guide part, and a shaft guide part extending from the central hole to guide the rotating shaft.

2. The drum-type washing machine of claim 1, further comprising a plurality of washing blades mounted to the rotating plate, the washing blades being projected toward an interior of the rotary drum.

3. The drum-type washing machine of claim 1, further comprising a bushing at a predetermined position of the shaft guide part and slidably contacting with the rotating shaft.

4. The drum-type washing machine of claim 2, wherein the plurality of washing blades are radially arranged on a front surface of the rotating plate.

5. The drum-type washing machine of claim 1, wherein the seat is a concavely depressed portion of a rear wall of the rotary drum.

6. The drum-type washing machine of claim 1, wherein the guide unit further comprises:

a guide surface slidably contacting with a rear surface of the rotating plate and formed with a central hole to allow the rotating shaft to pass through the guide surface; and a guide step forwardly projected from a front end of the guide surface to guide a sidewall of the rotating plate.

7. The drum-type washing machine of claim 6, further comprising a bushing positioned at an inner circumferential surface of the central hole and slidably contacting the rotating shaft.

8. The drum-type washing machine of claim 6, wherein the guide surface is a circular shape.

9. The drum-type washing machine of claim 1, wherein the rotating plate is formed to be forwardly convex at a central portion thereof.

* * * * *